US009792840B2

(12) United States Patent
Bermel et al.

(10) Patent No.: US 9,792,840 B2
(45) Date of Patent: Oct. 17, 2017

(54) TABBED NAMEPLATE ON A RING

(71) Applicant: Metalcraft, Inc., Mason City, IA (US)

(72) Inventors: Kyle Bermel, Clear Lake, IA (US); Brandon Nicholson, Mason City, IA (US)

(73) Assignee: Metalcraft, Inc., Mason City, IA (US)

( * ) Notice: Subject to any disclaimer, the term of this patent is extended or adjusted under 35 U.S.C. 154(b) by 0 days.

(21) Appl. No.: 15/284,951

(22) Filed: Oct. 4, 2016

(65) Prior Publication Data

US 2017/0098394 A1 Apr. 6, 2017

Related U.S. Application Data

(60) Provisional application No. 62/237,736, filed on Oct. 6, 2015.

(51) Int. Cl.
*G09F 3/14* (2006.01)
*G09F 3/02* (2006.01)

(52) U.S. Cl.
CPC . *G09F 3/14* (2013.01); *G09F 3/02* (2013.01)

(58) Field of Classification Search
CPC ..... G09F 3/14
See application file for complete search history.

(56) References Cited

U.S. PATENT DOCUMENTS 1,284,972 A * 11/1918 Anthony ..... G09F 3/14 24/128
1,401,338 A * 12/1921 Laracy ..... G09F 3/14 283/73
1,421,674 A * 7/1922 Colburn ..... G09F 3/14 40/6
1,530,680 A * 3/1925 Linden ..... G09F 3/0288 40/665
2,540,718 A * 2/1951 Duskin ..... G09F 3/18 40/6
2,979,840 A * 4/1961 Eastman ..... G09F 3/10 206/447
3,272,532 A * 9/1966 Owen ..... G09F 3/14 283/79
3,755,934 A * 9/1973 Porcher ..... G09F 3/14 283/81
4,907,359 A * 3/1990 Berman ..... G09F 3/14 40/330
2005/0081411 A1* 4/2005 Becker ..... G09F 3/20 40/6
2006/0213103 A1* 9/2006 Lewis ..... G09F 3/10 40/673
2015/0221242 A1* 8/2015 Cable ..... G09F 3/04 40/661.01

* cited by examiner

*Primary Examiner* — Gary C Hoge
(74) *Attorney, Agent, or Firm* — David M. Breiner; BrownWinick Law Firm

(57) ABSTRACT

Example embodiments relate to a tabbed nameplate on a ring apparatus and a method of moving a plurality of nameplates. In at least one nonlimiting example embodiment the method includes providing a first nameplate, inserting a holding member through a first aperture of a first tabbed portion of the first nameplate, and closing the holding member by moving a first end of the holding member to a second end of the holding member and using a connector to connect the first end to the second end. In at least one nonlimiting example embodiments the first nameplate has a first nameplate body and a first tabbed portion separated from each other by a cut.

16 Claims, 5 Drawing Sheets

TABBED NAMEPLATE ON A RING

CROSS REFERENCE TO RELATED APPLICATIONS

This application claims the benefit of U.S. patent application Ser. No. 62/237,736 filed with the United States Patent and Trademark Office on Oct. 6, 2015, the entire contents of which is herein incorporated by reference.

BACKGROUND

1. Field

Example embodiments relate to a tabbed nameplate on a ring apparatus and a method of moving nameplates from one location to another. In example embodiments the tabbed nameplate on a ring apparatus may temporarily retain nameplates in an orderly fashion and may be configured to facilitate removal of a nameplate body from a release liner.

2. Description of the Related Art

Nameplates are generally used to display information. Some nameplates, for example, are used to identify a piece of equipment. Other nameplates are used to identify persons. Yet other nameplates are used to identify rooms.

Nameplates are often produced in large volumes and are usually transported from one location to another for installation. To simplify installation, the nameplates are often provided in a box in a predetermined order. A drawback of using a box, however, is the risk the ordered nameplates may become disordered during transport. For example, when a box is used, there is chance the box may be bumped or jolted and the nameplates therein may be moved around. As another example, the box may be dropped and the nameplates may simply scatter on the ground. Thus, even if nameplates in a box are arranged in a particular order, there is still a chance the nameplates may become disordered during transport.

SUMMARY

Example embodiments relate to a tab nameplate on a ring apparatus. In example embodiments the tab nameplate on a ring apparatus may temporarily retain nameplates in an orderly fashion and may be configured to facilitate removal of a nameplate body from a release liner.

In accordance with example embodiments, a tabbed nameplate on a ring apparatus may include at least one nameplate having a nameplate body and a tabbed portion separated from each other by a cut. In at least one embodiment the nameplate may have a release liner under the nameplate body and the tabbed portion. The tabbed nameplate on a ring apparatus may include a holding member threaded through an aperture in the tabbed portion. The tabbed nameplate on a ring apparatus may also include a stopper on the holding member. In at least one example embodiment, the holding member may resemble a loop with two ends connected to one another.

In accordance with example embodiments, a method of moving a plurality of nameplates may include providing a first nameplate. In example embodiments the first nameplate may have a first nameplate body and a first tabbed portion separated from each other by a cut. The tabbed nameplate may also have a release liner under the first tabbed portion and the first nameplate body. In example embodiments the method may further include inserting a holding member through a first aperture of the first tabbed portion and closing the holding member by moving a first end of the holding member to a second end of the holding member.

BRIEF DESCRIPTION OF THE DRAWINGS

Example embodiments are described in detail below with reference to the attached drawing figures, wherein.

DETAILED DESCRIPTION

Figure 1:
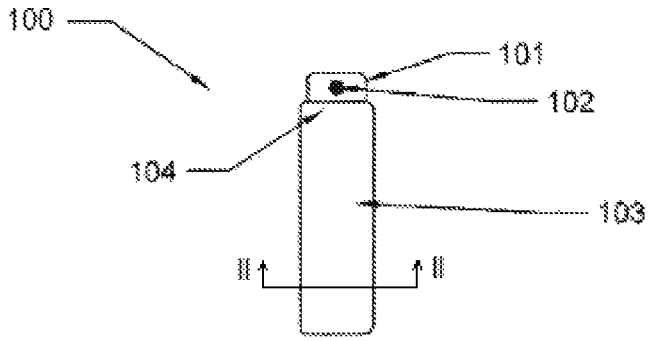
FIG. 1 is a view of a tabbed nameplate in accordance with example embodiments.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to tabbed nameplate on a ring apparatus and a method of moving a plurality of nameplates.

FIG. 1 is a top view of a tabbed nameplate 100. The tabbed nameplate 100 may include a nameplate body 103 and a tabbed portion 101. The tabbed portion 101 and the nameplate body 103 may be separated by a cut 104. The cut 104 may be a die cut, a die cut score, or a die cut crease. Having a cut 104 in the tabbed nameplate 100 may allow a person to separate the tabbed portion 101 from the nameplate body 103 by snapping or breaking the tabbed nameplate 100 along the cut 104. On the other hand, the cut 104 may be a kiss cut. In this latter embodiment, the cut 104 may be made down to a release liner 203 of the tabbed nameplate 100 and the tabbed portion 101 and the nameplate body 103 may be made by peeling the nameplate body 103 off of the release liner 203. Regardless, the cut 104 must be configured so a person, without the aid of a tool, can separate the tabbed portion 101 from the nameplate body 103.

Figure 2:
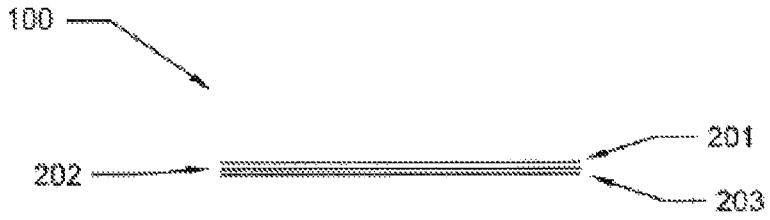
FIG. 2 is a cross section view of the tabbed nameplate in accordance with example embodiments.

FIG. 2 is a cross sectional view of the tabbed nameplate 100. As shown in FIG. 2, the tabbed nameplate 100 may include a metal layer 201, an adhesive 202 on the metal layer 201, and a release liner 203 which may function as a carrier material for the adhesive 202. In at least one example, the release liner 203 may keep the tabbed portion 101 and the nameplate body 103 together as the cut 104 may be kiss cut to the release liner 203. The cut 104, however, doesn't have to be a kiss cut to the liner, rather, it may also be die scored, or creased as described above.

Figure 3:
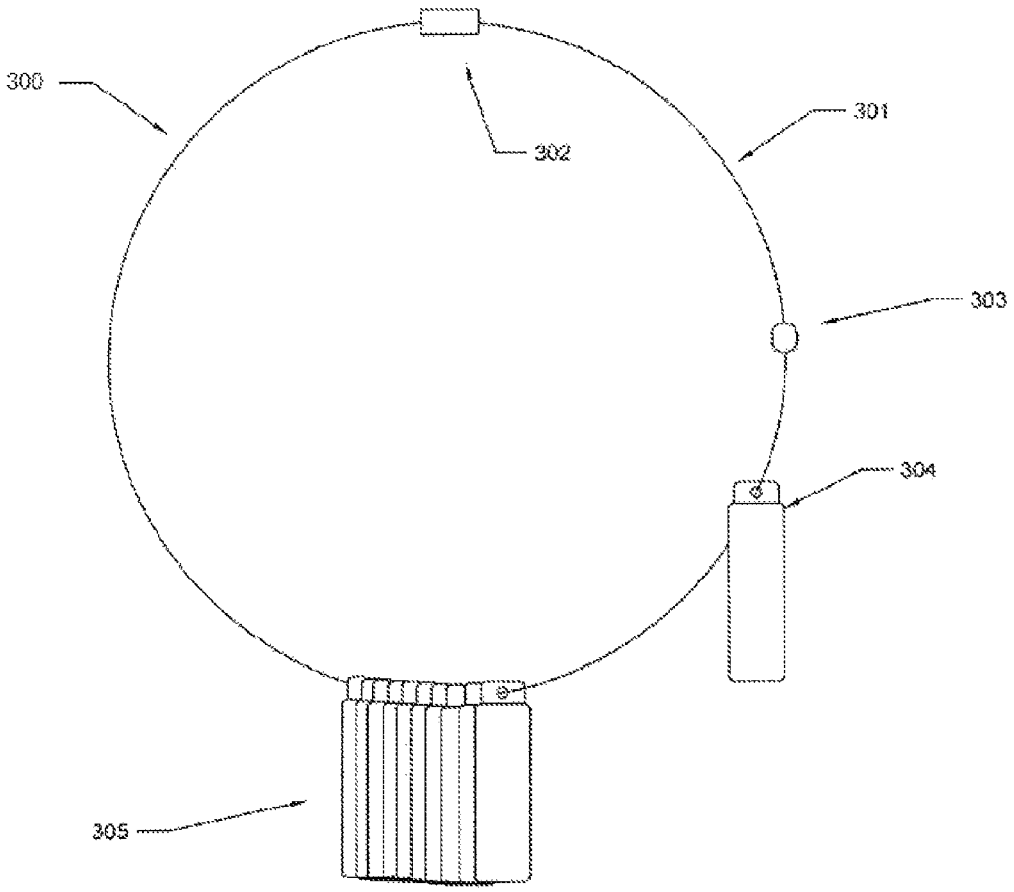
FIG. 3 is a view of a tabbed nameplate on a ring apparatus in accordance with example embodiments.

FIG. 3 illustrates a tabbed nameplate on a ring apparatus 300. The tabbed nameplate on a ring apparatus 300 may be configured to hold a plurality of tabbed nameplates 100. The tabbed nameplate on a ring apparatus 300 may include a holding member 301 which may be, but is not required to be, a rope, a cable, a string, a thread, a wire, a chain, a braided cable, or a line. In addition, the holding member 301 may be fabricated from a variety of materials including plastic, ceramic, and/or metal. Regardless, the holding member 301 may be a substantially thin member which pay pass through an aperture 102 of the tabbed portion 101 of the nameplate 100. In FIG. 3, element 304 may be substantially identical to the tabbed nameplate 100 and element 305 represents a plurality of tabbed nameplates which may be substantially identical to the tabbed nameplate 100.

The holding member 301 may include a connector 302, for example, a clasp, which may hold different ends of the holding member 301 together to form a loop. On the other hand, the connector 302 may be omitted and ends of the holding member 301 may be formed as hooks so ends of the holding member 301 may engage each other. The loop shape may allow the holding member 301 to act as a handle for the tab nameplate on a ring apparatus 300. In example embodiments, the tab nameplate on a ring apparatus 300 may further include a stopper 303. The stopper 303 may be configured to prevent the tabbed portion 101 of the tabbed nameplate 100 from moving along the holding member 301.

In example embodiments, the tabbed nameplate on a ring apparatus 300 may be used to transfer nameplates, for example 304 and/or 305, from one place to another. By holding onto any portion of the holding member 301 the nameplates 304 and/or 305 may be moved from one location to another without having any of the nameplates 304 and/or 305 lost or having an order thereof lost.

One advantage of using the tabbed nameplate on a ring apparatus 300 is that a sequence of nameplates 304 and/or 305 may be easily maintained. For example, the nameplates 304 and/or 305 may be placed on the tab nameplate on a ring apparatus 300 in a predefined order and the holding member 301 of the tab nameplate on a ring apparatus 300 may prevent the nameplates 304 and/or 305 from becoming disordered. For example, if nameplate 304 was printed with an image "1" and the last nameplate in the plurality of nameplates 305 was printed with an image "11" and these plates were in sequential order, the sequential order would stay the same until the nameplate/nameplates were used and/or applied. It is understood the above is only one example of how the invention may be practiced as the nameplates 304 and/or 305 are not intended to be limited to nameplates having numbers as such nameplates may, instead, have pictures, symbols, photographs, letters, names, or no printing or image at all.

In example embodiments the tab nameplate on a ring apparatus 300 may also be used to remove the liner 203 from the nameplate 100. For example, this may be done by grabbing nameplate 304 and moving the nameplate 304 in a direction away from the plurality of nameplates 305 and towards the stopper 303. Once the tabbed portion 101 of the nameplate 304 comes into contact with the stopper 303 the nameplate body 103 of nameplate 304 may be further moved while the tabbed portion 101 remains pressed against the holding member 301. Continued movement of the nameplate body 103 away from the holding member 301 allows the nameplate body 103 to separate from the release liner 203. An advantage of this method is that contamination of adhesive 202 on the nameplate body 103 may be reduced and/or minimized, if not eliminated entirely. As one skilled in the art would readily appreciate, this is vital to a proper application of said nameplates to another structure. Contamination of adhesive can hinder application and quality of a product.

In example embodiments the nameplates 304 and/or 305 are captured by the holding member 301 as the holding member 301 is generally threaded through the holes 102 of the nameplates 304 and/or 305. In one embodiment the stopper 303 is fixed at a location and cannot move on the holding member 301. In another embodiment the stopper 303 may be movable along the holding member 301 and fixed in place by another member such as, but not limited to, a set screw (not shown). For example, in this latter embodiment the stopper 303 may resemble a short cylinder having a threaded hole exposing the holding member 301 and the set screw may be inserted into the threaded hole and turned until it contacts the holding member 301 to fix the stopper 303 in place. While one skilled in the art would appreciate the advantages of a stopper 303, the invention is not limited thereto. For example, in another embodiment, the tabbed nameplate on a ring apparatus 300 may be fabricated without the stopper 303.

Figure 4:
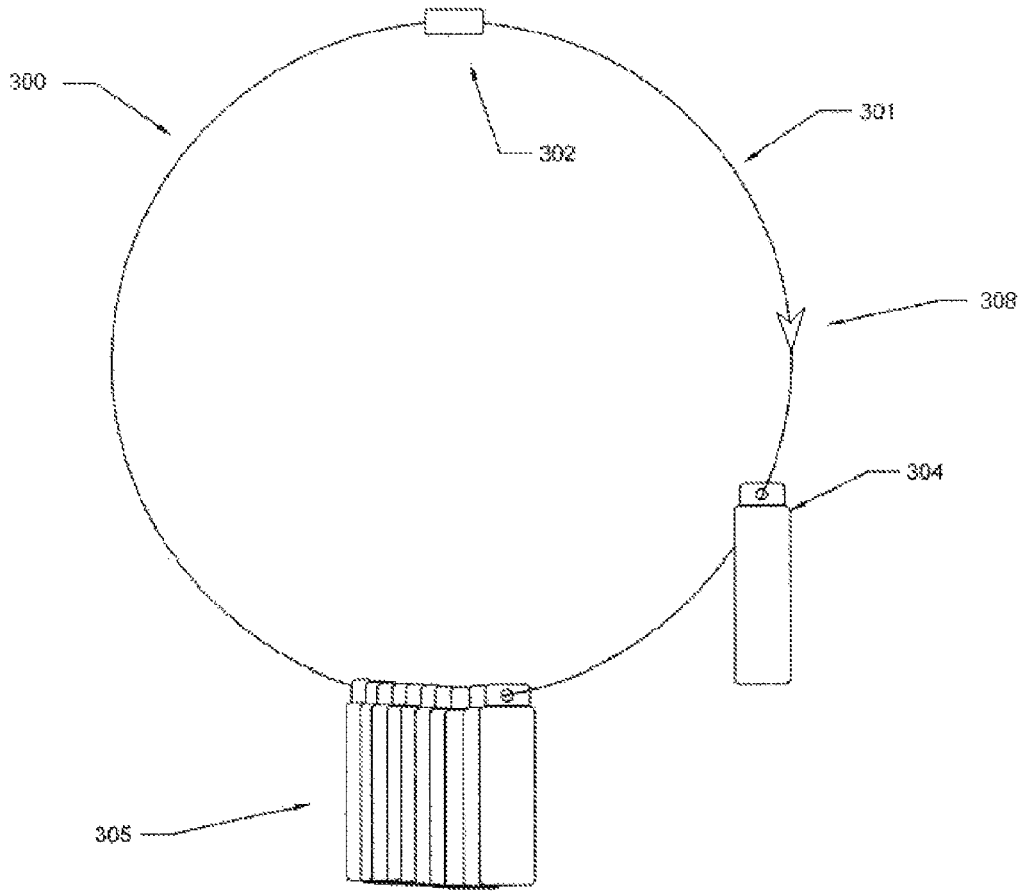
FIG. 4 is a view of another tabbed nameplate on a ring apparatus in accordance with example embodiments.

FIG. 4 is another view of a tabbed nameplate on a ring apparatus 300. The apparatus is substantially identical to the tabbed nameplate on a ring apparatus 300 illustrated in FIG. 3 in that it has a holding member 301 which may be, but is not required to be, a rope, a cable, a string, a thread, a wire, a chain, a braided cable, or a line. In addition, the holding member 301 may be fabricated from a variety of materials including plastic, ceramic, and/or metal, polyvinyl, or a polyester. Regardless, the holding member 301 may be a substantially thin member which pay pass through an aperture 102 of the tabbed portion 101 of the nameplate 100. In FIG. 4, element 304 may be substantially identical to the tabbed nameplate 100 and element 305 represents a plurality of tabbed nameplates which may be substantially identical to the tabbed nameplate 100.

Figure 5A:
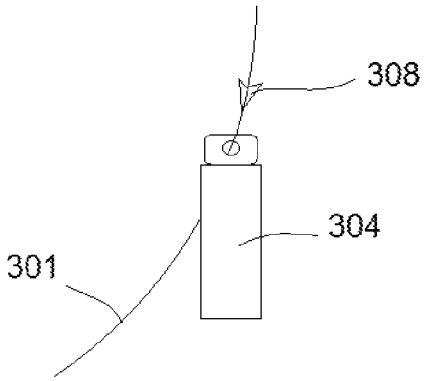
FIGS. 5A-5C are views of a tabbed nameplate being moved along a holder and past a slip over structure.
Figure 5B:
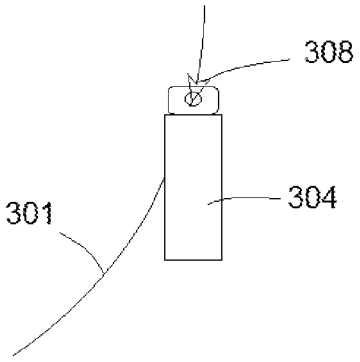
Figure 5C:
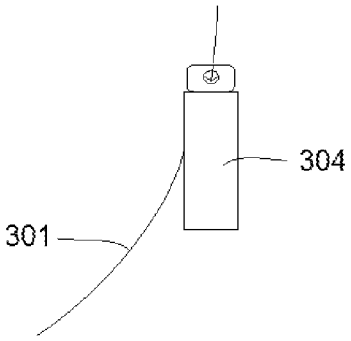

In FIG. 4, the holding member 301 may include a connector 302 which may connect ends of the holding member 301 together. For example, the connector 302 may be a clasp or some similar structure. However, rather than having a stopper 303, the tabbed nameplate on a ring apparatus 300 of FIG. 4 includes a slip over member 308. The slip over member 308 may, for example, resemble an elastic member which elastically deforms allowing the element 304 to move past the slip over member 308, but is configured in such a way that the element 304 cannot move backwards through the slip over member 308. For example, as shown in FIG. 5A element 304 may be moved along the holding member 301 towards the slip over member 308. The slip over member 308 may have flanges that elastically deform allowing the element 304 to move past the slip over member 308. However, once element 304 moves beyond the slip over member 308 the flanges elastically return to their original configuration. The distance between ends of the flanges of the slip over member 308 may be larger than the diameter of the hole 102 of element 304, thus, backwards motion of element 304 is prevented.

Figure 6:
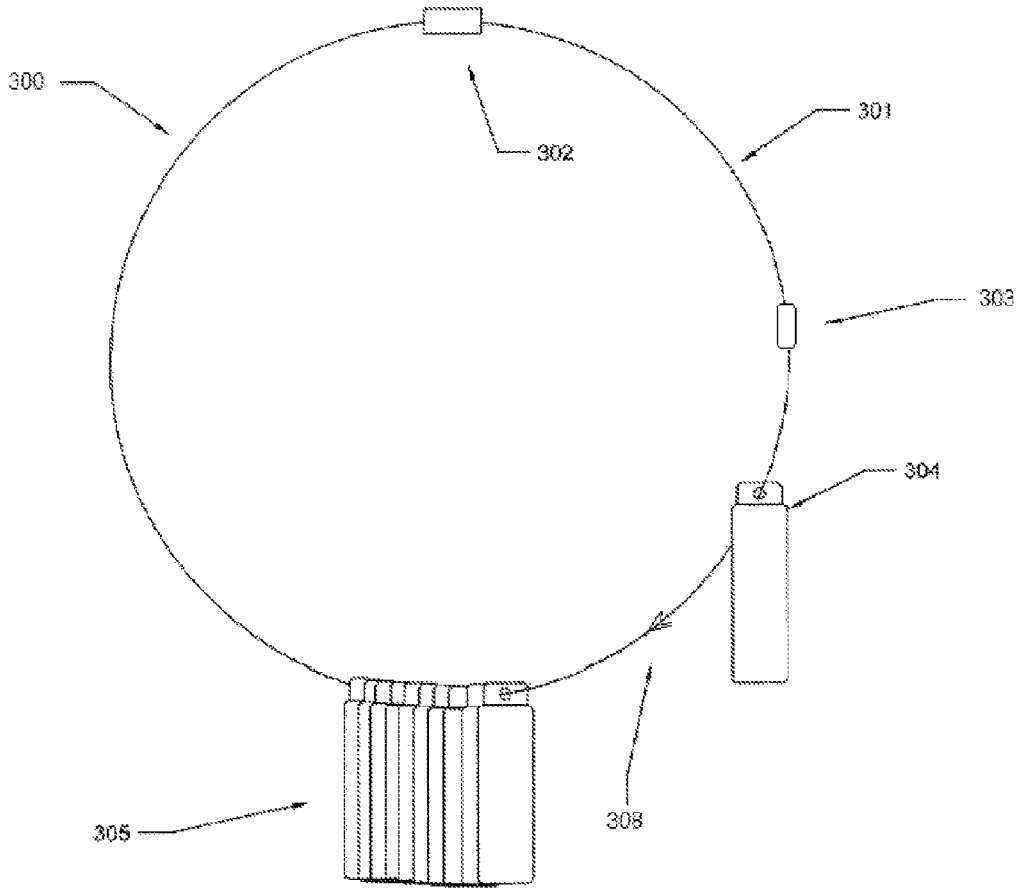
FIG. 6 is a view of another tabbed nameplate on a ring apparatus in accordance with example embodiments

In example embodiments various elements of the example tabbed nameplate on a ring apparatuses 300 may be combined. For example, as shown in FIG. 6, another example of a tabbed nameplate on a ring apparatus 300 is provided which includes both a stopper 303 and a slip over member 308. This combined apparatus has advantages of the prior described tab nameplate on a ring apparatuses 300 in that it has a slip over member 308 to keep tabbed portions 101 of tabbed nameplates (where the nameplate body 103 is removed) separate from elements 304 where the nameplate bodies 103 and the tabbed portions 101 are intact while still having a stopper 303 as an aid to removing the a tabbed portion 101 of an element 304 from element 304' a nameplate body 103.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What is claimed is:

1. A method of moving a plurality of nameplates comprising:

providing a first tabbed nameplate, the first tabbed nameplate having a first nameplate body and a first tabbed portion separated from each other by a cut;

inserting a holding member through a first aperture of the first tabbed portion; and closing the holding member by moving a first end of the holding member to a second end of the holding member and using a connector to connect the first end to the second end, wherein the holding member includes a stopper configured to prevent the first tabbed nameplate from moving along the holding member.

2. The method of claim 1, wherein the cut is one of a kiss cut, die cut, a die cut score, and a die cut crease.

3. The method of claim 1, wherein the connector is a clasp.

4. The method of claim 1, wherein the holding member is comprised of one of a rope, a cable, a string, a thread, a wire, a chain, and a line.

5. The method of claim 1, wherein the first tabbed nameplate includes a release liner under the first nameplate body.

6. The method of claim 5, wherein the release liner extends under the first tabbed portion.

7. A method of moving a plurality of nameplates comprising:

providing a first tabbed portion nameplate, the tabbed nameplate having a first nameplate body and a first tabbed portion separated from each other by a cut;

inserting a holding member through a first aperture of the first tabbed portion;

closing the holding member by moving a first end of the holding member to a second end of the holding member and using a connector to connect the first end to the second end; and moving the first tabbed nameplate past a slip-over member arranged on the holding member.

8. A tab nameplate on a ring apparatus comprising:

at least one tabbed nameplate having a nameplate body and a tabbed portion separated from each other by a cut;

a holding member threaded through an aperture in the tabbed portion, wherein the holding member is a substantially closed member; and a stopper on the holding member configured to prevent the at least one tabbed nameplate from moving along the holding member.

9. The apparatus of claim 8, wherein the cut is one of a kiss cut, die cut, a die cut score, and a die cut crease.

10. The apparatus of claim 8, further comprising:

a connector to close the holding member.

11. The apparatus of claim 8, wherein the holding member is comprised of one of a rope, a cable, a string, a thread, a wire, a chain, and a line.

12. A tab name nameplate on a ring apparatus comprising:

at least one tabbed nameplate having a nameplate body and a tabbed portion separated from each other by a cut;

a holding member threaded through an aperture in the tabbed portion, wherein the holding member is a substantially closed member; and a slipover member on the holding member.

13. A tab nameplate on a ring apparatus comprising:

at least one tabbed nameplate having a nameplate body and a tabbed portion separated from each other by a cut;

a holding member threaded through an aperture in the tabbed portion, wherein the holding member is a substantially closed member; and a stopper on the holding member configured to prevent the at least one tabbed nameplate from moving past the stopper.

14. The apparatus of claim 13, wherein the cut is one of a kiss cut, die cut, a die cut score, and a die cut crease.

15. The apparatus of claim 13, further comprising:

a connector to close the holding member.

16. The apparatus of claim 13, wherein the holding member is comprised of one of a rope, a cable, a string, a thread, a wire, a chain, and a line.

* * * * *